US009332350B2

(12) United States Patent
Sun et al.

(10) Patent No.: US 9,332,350 B2
(45) Date of Patent: May 3, 2016

(54) EARPHONE PULLING AND PLUGGING DETECTION CIRCUIT

(75) Inventors: Qinli Sun, Shenzhen (CN); Haibo She, Shenzhen (CN); Wengang Zhang, Shenzhen (CN); Fengpeng Liu, Shenzhen (CN); Mao Liang, Shenzhen (CN)

(73) Assignee: ZTE Corporation, Shenzhen (CN)

( * ) Notice: Subject to any disclaimer, the term of this patent is extended or adjusted under 35 U.S.C. 154(b) by 828 days.

(21) Appl. No.: 13/576,756

(22) PCT Filed: Jan. 31, 2011

(86) PCT No.: PCT/CN2011/070854

§ 371 (c)(1), (2), (4) Date: Aug. 2, 2012

(87) PCT Pub. No.: WO2012/031468

PCT Pub. Date: Mar. 15, 2012

(65) Prior Publication Data

US 2012/0308031 A1 Dec. 6, 2012

(30) Foreign Application Priority Data

Sep. 8, 2010 (CN) ..... 2010 2 0525527 U

(51) Int. Cl.
*H04R 1/10* (2006.01)
*H04R 5/04* (2006.01)
(Continued)

(52) U.S. Cl.
CPC ..... *H04R 5/04* (2013.01); *H01R 13/6616* (2013.01); *H01R 13/7033* (2013.01); *H01R 24/58* (2013.01); *H04R 5/033* (2013.01); *H04R 2420/05* (2013.01)

(58) Field of Classification Search
CPC ..... H04R 5/033; H04R 5/04; H04R 2420/05; H01R 24/58; H01R 13/6616; H01R 13/7033
USPC ..... 381/74, 77
See application file for complete search history.

(56) References Cited

U.S. PATENT DOCUMENTS

2004/0190384 A1 9/2004 Hsieh et al.
2009/0316926 A1* 12/2009 Hung et al. ..... H04R 3/00 381/71.6

FOREIGN PATENT DOCUMENTS

CN 101610439 A 12/2009
CN 101610440 A 12/2009
(Continued)

OTHER PUBLICATIONS

English-language abstract of Chinese Patent No. 101610439A, European Patent Office, Dec. 23, 2009.
English-language abstract of Chinese Patent No. 101610440A, European Patent Office, Dec. 23, 2009.
English-language abstract of Taiwan Patent No. 201004389A, European Patent Office, Jan. 16, 2010.
(Continued)

*Primary Examiner* — Paul S Kim
(74) *Attorney, Agent, or Firm* — Dascenzo Intellectual Property Law, P.C.

(57) ABSTRACT

Earphone plugging and unplugging detection circuits are disclosed in the present invention, wherein one of the circuits includes a left sound channel (L) pin, a first pin which can be connected and disconnected with the L pin, a right sound channel (R) pin, and a second pin which can be connected and disconnected with the R pin; the circuit also includes a left detection signal line which is connected with the first pin, the left detection signal line is connected or configured with a pull-up resistor, the first pin is electrically connected with the second pin, and the L pin and the R pin are connected with a pull-down resistor respectively. The present invention not only has the advantages of having simple circuit, small area occupied by PCB and low hardware cost, but also can effectively improve the reliability of the earphone plugging and unplugging detection.

6 Claims, 2 Drawing Sheets

(51) Int. Cl.

| | |
|---|---|
| ***H01R 13/66*** | (2006.01) |
| ***H01R 13/703*** | (2006.01) |
| *H04R 5/033* | (2006.01) |
| *H01R 24/58* | (2011.01) |

(56) References Cited

FOREIGN PATENT DOCUMENTS

| | | | |
|---|---|---|---|
| CN | 2017816180 | U | 3/2011 |
| JP | 58-171194 | A | 10/1983 |
| JP | 2005-045477 | A | 2/2005 |
| JP | 2007-312030 | A | 11/2007 |
| TW | 201004389 | A | 1/2010 |
| TW | 201004390 | A | 1/2010 |

OTHER PUBLICATIONS

English-language abstract of Taiwan Patent No. 201004390A, European Patent Office, Jan. 16, 2010.

English-language abstract of Chinese Patent No. 201781618U, European Patent Office, Mar. 30, 2011.

English-language abstract of Japanese Patent No. 2005-045477A, Japan Patent Office, Feb. 17, 2005.

English-language abstract of Japanese Patent No. 2007-312030A, Japan Patent Office, Nov. 29, 2007.

English-language abstract of Japanese Patent Publication No. 58-171194 A, European Patent Office, Oct. 7, 1983.

* cited by examiner

EARPHONE PULLING AND PLUGGING DETECTION CIRCUIT

TECHNICAL FIELD

The present invention relates to the field of terminal device technologies, and more especially, to an earphone plugging and unplugging detection circuit.

BACKGROUND OF THE RELATED ART

The earphone has become a standard configured attachment of the terminal product. When the earphone is used, it usually requires that the terminal product automatically recognize the earphone plugging and unplugging state. Therefore, it needs to use the earphone plugging and unplugging detection circuit. The forms of the earphone plugging and unplugging detection circuit are various, and the spring leaf-type earphone plugging and unplugging detection circuit has the advantages of having simple circuit, low cost, and small area occupied by the Printed Circuit Board (PCB), and thus is widely used.

FIG. 1 is a schematic diagram of the definitions of the four-segment earphone plug and socket pin, and there are two types of four-segment earphone plugs: 3.5 mm and 2.5 mm, the definitions of the plug pins are: from the root to the end, ground (GND), microphone (MIC), right sound channel (R) and left sound channel (L). The three-segment earphone plug differs from the four-segment earphone plug in that the three-segment earphone plug does not have the MIC pin. The pins of the four-segment earphone socket pins are defined as comprising: the ground (GND) 1, the right sound channel 2 (R), the second pin 3 that forms a normally closed connection with the pin 2, the left sound channel 5 (L), and the first pin 4 that forms a normally closed connection with the pin 5, and the microphone 6 (MIC). The difference between the three-segment earphone socket and the four-segment earphone socket is that the three-segment earphone socket does not have the microphone (MIC) pin.

At present, a pair of mechanical spring leaves such as the pin 4 and the pin 5 that forms a normally closed connection with the pin 4 inside the earphone socket are used to implement the earphone plugging and unplugging detection. When the earphone is plugged in, the pin 5 is disconnected, and is electrically disconnected with the pin 4, thus an interruption is formed in the hardware and is reported to the control circuit, and the terminal equipment enables the interruption service routine. When the earphone is unplugged, the control circuit detects the earphone unplugging and exits from the service routine. The earphone plugging and unplugging makes the pin 4 connected and disconnected with the pin 5 of the earphone socket. Therefore, whether the state of earphone plugging and unplugging is able to be correctly detected is closely related to the mechanical spring leaves inside the earphone socket. When the earphone socket has a quality problem, for example, the pin 4 and the pin 5 should be normally closed but actually they are not, it will cause the controller to mistakenly judge that there are earphones plugged in, the earphone symbol appears in the terminal product, and meanwhile the audio path is switched to the earphone end, causing the entire terminal product to be in the silent mode, which seriously affects the normal use.

SUMMARY OF THE INVENTION

The technical problem to be solved in the present invention is to provide an earphone plugging and unplugging detection circuit to more reliably detect the states of earphone plugging and unplugging.

To solve the aforementioned technical problem, the present invention provides an earphone plugging and unplugging detection circuit. The circuit comprises: a left sound channel (L) pin, a first pin which can be connected and disconnected with the L pin, a right sound channel (R) pin, and a second pin that can be connected and disconnected with the R pin, wherein:

the circuit also comprises a left detection signal line connected to said first pin, the left detection signal line is connected or configured with a pull-up resistor, the first pin is electrically connected with the second pin, and the L pin and the R pin are respectively connected with a pull-down resistor.

When the resistance of the pull-up resistor and the pull-down resistor makes the L pin connected with the first pin and/or the R pin connected with the second pin, the left detection signal line is pulled down to a low level, and when the L pin is disconnected with the first pin and the R pin is disconnected with the second pin, the left detection signal line is pulled up to a high level.

To solve the aforementioned technical problem, the present invention also provides an earphone plugging and unplugging detection circuit, the circuit comprising: a left sound channel (L) pin, a first pin which can be connected and disconnected with the L pin, a right sound channel (R) pin, and a second pin which can be connected and disconnected with the R pin, wherein:

The circuit might also comprise a left detection signal line connected to said first pin, the left detection signal line is connected or configured with a pull-down resistor, said first pin is electrically connected with said second pin, and the L pin and the R pin are connected with a pull-up resistor respectively.

When the resistance of the pull-up resistor and the pull-down resistor makes the L pin connected with the first pin and/or the R pin connected with the second pin, the left detection signal line is pulled up to a high level, and when the L pin is disconnected with the first pin and the R pin is disconnected with the second pin, the left detection signal line is pulled down to a low level.

The pull-up resistor respectively connected with the L pin and the R pin is larger than 9 to 10 times of an earphone coil resistor.

To solve the aforementioned technical problem, the present invention also provides an earphone plugging and unplugging detection circuit, the circuit comprising: a left sound channel (L) pin, a first pin which can be connected and disconnected with the L pin, a right sound channel (R) pin and a second pin which can be connected and disconnected with the R pin, wherein:

the circuit might also comprise a left detection signal line connected with said first pin and a right detection signal line connected with the second pin, the left detection signal line and the right detection signal line are connected or configured with a pull-up resistor respectively, and the L pin and the R pin are connected with a pull-down resistor respectively.

When the resistance of the pull-up resistor and the pull-down resistor makes the L pin connected with the first pin, the left detection signal line is pulled down to a low level, and when the L pin is disconnected with the first pin, the left detection signal line is pulled up to a high level. Moreover, the right detection signal line is pulled down to the low level when the R pin is made connected with the second pin, and the right detection signal line is pulled up to the high level when the R pin is disconnected with the second pin.

To solve the aforementioned technical problem, the present invention also provides an earphone plugging and unplugging detection circuit, the circuit comprising: a left sound channel (L) pin, a first pin which can be connected and disconnected with the L pin, a right sound channel (R) pin and a second pin which can be connected and disconnected with the R pin, wherein:

the circuit might also comprise a left detection signal line connected with said first pin and a right detection signal line connected with the second pin, the left detection signal line and the right detection signal line are connected or configured with a pull-down resistor respectively, and the L pin and the R pin are connected with a pull-up resistor respectively.

When the resistance of the pull-up resistor and the pull-down resistor makes the L pin connected with the first pin, the left detection signal line is pulled up to a high level; when the L pin is disconnected with the first pin, the left detection signal line is pulled down to a low level; moreover, the right detection signal line is pulled up to a high level when the R pin is connected with the second pin, and the right detection signal line is pulled down to the low level when the R pin is disconnected with the second pin.

The pull-up resistor respectively connected with the L pin and the R pin is larger than 9 to 10 times of an earphone coil resistor.

In summary, the present invention not only has the advantages of having simple circuit, small area occupied by the PCB and low hardware cost, but also can effectively improve the reliability of the earphone plugging and unplugging detection.

PREFERRED EMBODIMENTS OF THE PRESENT INVENTION

The present invention will be described in detail below with reference to the accompanying drawings. It should be noted that without conflict, the embodiments in this application and the characteristics of the embodiments can be combined randomly with each other.

Figure 1:
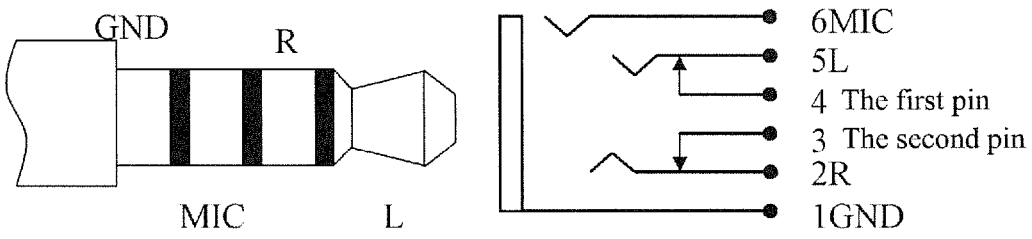
FIG. 1 is a schematic diagram of the definition of the four-segment earphone plug and socket pins in the prior art.
Figure 2:
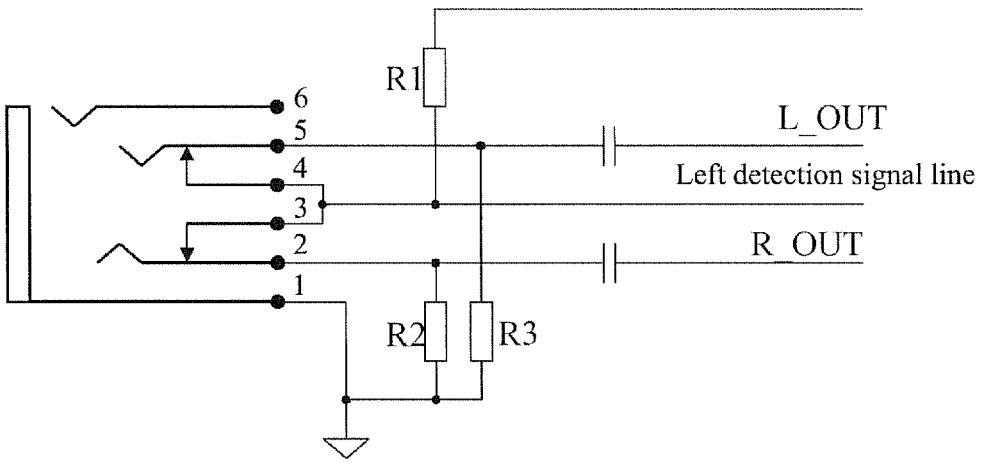
FIG. 2 is a schematic diagram of a first embodiment of the earphone plugging and unplugging detection circuit in accordance with the present invention.

The First Embodiment:

FIG. 2 shows an earphone plugging and unplugging detection circuit in the present invention, comprising: the L pin 5, the first pin 4 that forms a normally closed connection with the L pin 5, the R pin 2, the second pin 3 that forms a normally closed connection with the R pin 2, and the left detection signal line connected with the first pin 4, where the left detection signal line is connected or configured with the pull-up resistor R1, the first pin 4 is electrically connected with the second pin 3, and the L pin 5 and the R pin 2 are connected with a pull-down resistor respectively.

The resistor R1 connected with the left detection signal line is a pull-up resistor, and if the left detection signal line can internally configure a pull-up resistor, the R1 can be removed. The R1 and the pull-down resistor R3 connected with the left channel output (L_OUT) signal line as well as the pull-down resistor R2 connected with the right channel output (R_OUT) signal line constitute a voltage divider circuit, and moreover, the pull-down capabilities of the R2 and the R3 are much stronger than the pull-up capability of the R1 such that when the earphones are not plugged in, the left detection signal line is at the low level, if the resistance of the R1 is at least 10 times of the R2 and the R3, for example, the resistance of the R1 is 100 KΩ, and the resistance of the R2 and the R3 is 10 KΩ. Here it does not limit to more than 10 times, and a value, such as 9 times, 9.5 times, and so on, can be chosen based on experience.

The second pin 3 and the first pin 4 of the earphone socket are electrically connected together. When the earphones are plugged in, the R pin 2 and the L pin 5 of the earphone socket are disconnected, and disconnected electrically with the second pin 3 and the first pin 4 respectively, the pull-down resistors R2 and R3 do not work, the pull-up resistor R1 pulls the left detection signal line up to the high level, forming a hardware interruption, and the earphone plugging is detected. The earphone unplugging is an opposite process. When a pair of the R pin 2 and the second pin 3 or the first pin 4 and the L pin 5 do not form a normal close due to the quality problem of the earphone socket, while the other pair can still work normally, for example, the normal close of the first pin 4 and the L pin 5 fails, while the R1 and the R2 can share partial voltage via the normally closed R pin 2 and second pin 3, and the R pin 2 is disconnected and disconnected electrically with the second pin 3 when the earphones are plugged in, the left detection signal line is pulled up to the high level, forming a hardware interruption, and the earphone plugging is detected. The earphone unplugging is an opposite process. It can be seen that the detection circuit only requires one group of normally closed pins, which provides the reliability of the earphone plugging and unplugging detection.

Figure 3:
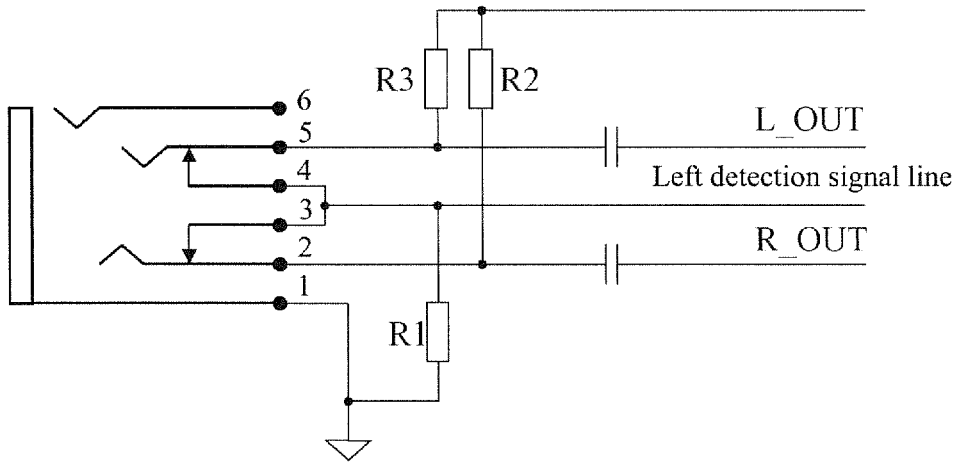
FIG. 3 is a schematic diagram of a second embodiment of the earphone plugging and unplugging detection circuit in accordance with the present invention.

The Second Embodiment:

FIG. 3 shows an earphone plugging and unplugging detection circuit in the present invention, the circuit comprising: the L pin 5, the first pin 4 which can be connected and disconnected with the L pin 5, the R pin 2, the second pin 3 which can be connected and disconnected with the R pin 2, and the left detection signal line connected with the first pin 4, where the left detection signal line is connected or configured with the pull-down resistor R1, the first pin 4 is electrically connected with the second pin 3, the L pin 5 and the R pin 2 are connected with the pull-up resistors R3 and R2 respectively.

The resistor R1 connected with the left detection signal line is a pull-down resistor, and if the left detection signal line can internally configure a pull-down resistor, the R1 can be removed. The R1 and the pull-up resistor R3 connected with the left channel output (L_OUT) signal line as well as the pull-up resistor R2 connected with the right channel output (R_OUT) signal line constitute a voltage divider circuit, and moreover, the pull-up capabilities of the pull-up resistors R2 and the R3 are much stronger than the pull-down capability of the pull-down R1 such that when the earphones are not plugged in, the left detection signal line is at the high level, and meanwhile, the resistance of the R2 and the R3 is preferably greater than 9-10 times of 32Ω (the earphone coil resistor), to avoid sharing the current of the earphone heavily in the earphone plug-in state, which affects the earphone effect.

When the earphones are plugged in, the R pin 2 and the L pin 5 of the earphone socket are disconnected, and disconnected electrically with the second pin 3 and the first pin 4 respectively, the pull-up resistors R2 and R3 do not work, the pull-down resistor R1 pulls the left detection signal line down to the low level, forming a hardware interruption, and the earphone plugging is detected. The earphone unplugging is an opposite process. The detection circuit only requires one group of normally closed pins. For example, the normal close of the first pin 4 and the L pin 5 fails, while the R1 and the R2 can still share partial voltage via the normally closed R pin 2 and second pin 3, and the R pin 2 is disconnected and disconnected electrically with the second pin 3 when the earphones are plugged in, the left detection signal line is pulled up to the high level, forming a hardware interruption, and the earphone plugging is detected. The earphone unplugging is an opposite process.

Figure 4:
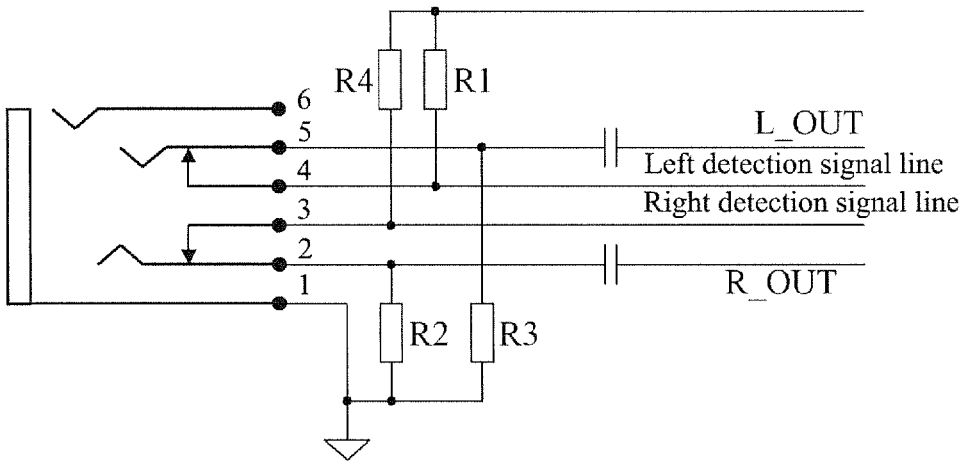
FIG. 4 is a schematic diagram of a third embodiment of the earphone plugging and unplugging detection circuit in accordance with the present invention.

The Third Embodiment:

FIG. 4 shows an earphone plugging and unplugging detection circuit in the present invention, the circuit comprising: the L pin 5, the first pin 4 which can be connected and disconnected with the L pin 5, the R pin 2, the second pin 3 which can be connected and disconnected with the R pin, the left detection signal line connected with the first pin 4, and the right detection signal line connected with the second pin 3, where the left detection signal line and the right detection signal line are connected or configured with a pull-up resistor respectively, and the L pin and the R pin are connected with a pull-down resistor respectively.

The resistor R1 connected with the left detection signal line is a pull-up resistor, and if the left detection signal line can internally configure a pull-up resistor, the R1 can be removed. The R1 and the pull-down resistor R3 connected with the left channel output (L_OUT) signal line can form a voltage divider circuit via the normally closed first pin 4 and L pin 5. The pull-up resistor connected with the right detection signal line is R4, and if the right detection signal line can internally configure a pull-up resistor, the R4 can be removed. The R4 and the pull-down resistor R2 on the right channel output (R_OUT) signal line form a voltage divider circuit via the normally closed R pin 2 and second pin 3, and moreover, the pull-down capabilities of the R2 and the R3 are much stronger than the pull-up capabilities of the R1 and R4 such that when the earphones are not plugged in, the left detection signal line and the right detection signal line are both pulled down to the low level.

When the earphones are plugged in, the R pin 2 and the L pin 5 of the earphone socket are disconnected, and disconnected electrically with the second pin 3 and the first pin 4 respectively, the pull-down resistors R2 and R3 do not work, the pull-up resistor R1 pulls both the left detection signal line and the right detection signal line up to the high level, forming a hardware interruption, and the earphone plugging is detected. The earphone unplugging is an opposite process. When a pair of the normally closed pins fails, one of the detection pins is at the high level, while the other one is at the low level, at which moment, the control circuit considers that there is no earphone plugged in. When the earphones are plugged in, the pair of still working earphone spring leaves are disconnected and separated with each other electrically, at which moment, both the two detection pins are at the high level, and the control circuit considers that there are earphones plugged in, and the earphones are detected. It can be seen that when a pair of normally closed pins fails, the detection circuit can still correctly detect the plugging and unplugging of the earphones, which effectively improves the reliability of the earphone plugging and unplugging.

Figure 5:
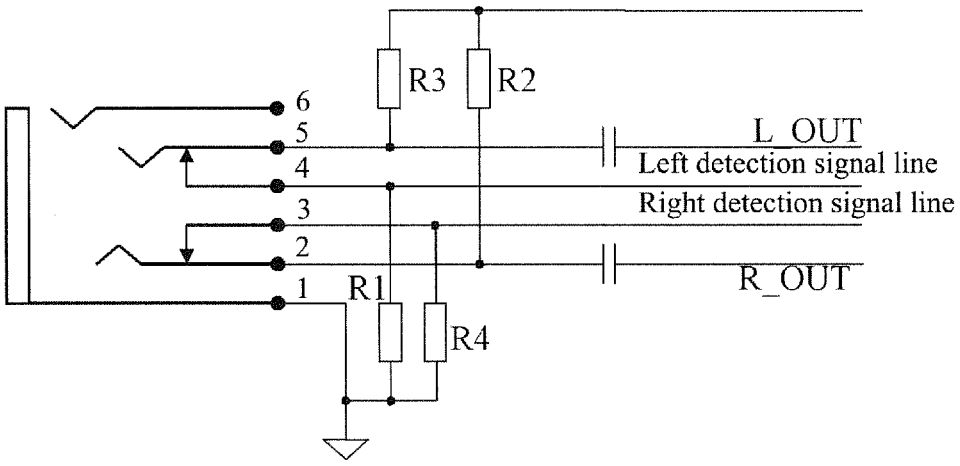
FIG. 5 is a schematic diagram of a fourth embodiment of the earphone plugging and unplugging detection circuit in accordance with the present invention.

The Fourth Embodiment:

FIG. 5 shows an earphone plugging and unplugging detection circuit in the present invention, the circuit comprising: the L pin 5, the first pin 4 which can be connected and disconnected with the L pin 5, the R pin 2, the second pin 3 which can be connected and disconnected with the R pin 2, the left detection signal line connected with the first pin 4, and the right detection signal line connected with the second pin 3, where the left detection signal line and the right detection signal line are connected or configured with a pull-down resistor respectively, and the L pin 5 and the R pin 2 are connected with a pull-up resistor respectively.

The resistor R1 connected with the left detection signal line is a pull-down resistor, and if the left detection signal line can internally configure a pull-down resistor, the R1 can be removed. The R1 and the pull-up resistor R3 connected with the left channel output (L_OUT) signal line can form a voltage divider circuit. The pull-down resistor connected with the right detection signal line is R4, and if the right detection signal line can internally configure a pull-down resistor, the R4 can be removed. The R4 and the pull-up resistor R2 on the right channel output (R_OUT) signal line form a voltage divider circuit, and moreover, the pull-up capabilities of the R2 and the R3 are much stronger than the pull-up capabilities of the R1 and R4 such that when the earphones are not plugged in, the left detection signal line and the right detection signal line are both pulled up to the high level. Meanwhile, the resistance of the R2 and the R3 is preferably greater than 9-10 times of 32Ω (the earphone coil resistor), to avoid sharing the current of the earphone heavily in the earphone plug-in state, which affects the earphone effect.

When the earphones are plugged in, the R pin 2 and the L pin 5 of the earphone socket are disconnected, and disconnected electrically with the second pin 3 and the first pin 4, the pull-up resistors R2 and R3 do not work, the pull-down resistor pulls the left detection signal line and the right detection signal line down to the low level, forming a hardware interruption, and the earphone plugging is detected. The earphone unplugging is an opposite process. When a pair of the normally closed pins does not work, one of the detection pins is the low level, while the other one is the high level, at which moment, the control circuit considers that there are no earphones plugged in. When the earphones are plugged in, the pair of still working earphone spring leaves are disconnected and separated with each other electrically, at which moment, both the two detection pins are at the low level, the control circuit considers that there are earphones plugged in, and the earphones are detected. It can be seen that when a pair of normally closed pins fails, the detection circuit can still correctly detect the plugging and unplugging of the earphones, which effectively improves the reliability of the plugging and unplugging of the earphones.

The embodiment also provides a terminal using the aforementioned earphone plugging and unplugging detection circuit, the earphone plugging and unplugging detection circuit is set in the shell of the terminal, and the structure of the earphone plugging and unplugging detection circuit is as described above and thus will not be discussed here.

The two-spring leave earphone plugging and unplugging detection circuit also can be applied to an earphone socket having two pairs of normally opened pins, with the principle being similar. The forms of the above circuits can all improve the reliability of the earphone plugging and unplugging detection, and since the first embodiment occupies few resources and has a relatively simple circuit, the first embodiment is preferred. Moreover, when the detection pins can internally configure a pull-up or pull-down resistor, the pull-up or pull-down resistor on the detection pins can be removed, thus further saving the PCB space and the hardware costs.

The above description is of only the preferred embodiments of the present invention and is not intended to limit the present invention. For those skilled in the field, the present invention can have a variety of changes and modifications. Without departing from the spirit and principles of the present invention, any change, equivalent replacement and improvement should be included within the protection scope of the present invention.

INDUSTRIAL APPLICABILITY

The present invention not only has the advantages of having simple circuit, small area occupied by the PCB and low hardware cost, but also can effectively improve the reliability of the earphone plugging and unplugging detection.

What is claimed is:

1. An earphone plugging and unplugging detection circuit, the circuit comprising: a left sound channel (L) pin, a first pin which can be connected and disconnected with the L pin, a right sound channel (R) pin and a second pin which can be connected and disconnected with the R pin, wherein the first pin forms a first normally closed connection with the L pin and the second pin forms a second normally closed connection with the R pin, and wherein:

the circuit also comprises a left detection signal line connected with said first pin and a right detection signal line connected with the second pin, the left detection signal line and the right detection signal line are connected or configured with one of a pull-up resistor and a pull-down resistor respectively, and the L pin and the R pin are connected with the other of the pull-up resistor and the pull-down resistor respectively;

wherein the left detection signal line is not electrically connected with the right detection signal line, such that when one of the first normally closed connection and the second normally closed connection fails, the circuit still correctly detects plugging and unplugging of an earphone, thereby effectively improving the reliability of the plugging and unplugging of the earphone.

2. The circuit of claim 1, wherein:

the left detection signal line and the right detection signal line are connected or configured with the pull-up resistor respectively, and the L pin and the R pin are connected with the pull-down resistor respectively.

3. The circuit of claim 2, wherein:

when the resistance of the pull-up resistor and the pull-down resistor makes the L pin connected with the first pin, the left detection signal line is pulled down to a low level, and when the L pin is disconnected with the first pin, the left detection signal line is pulled up to a high level, moreover, the right detection signal line is pulled down to the low level when the R pin is made connected with the second pin, and the right detection signal line is pulled up to the high level when the R pin is disconnected with the second pin.

4. The circuit of claim 1, wherein:

the left detection signal line and the right detection signal line are connected or configured with the pull-down resistor respectively, and the L pin and the R pin are connected with the pull-up resistor respectively.

5. The circuit of claim 4, wherein:

when the resistance of the pull-up resistor and the pull-down resistor makes the L pin connected with the first pin, the left detection signal line is pulled up to a high level; when the L pin is disconnected with the first pin, the left detection signal line is pulled down to a low level; moreover, the right detection signal line is pulled up to a high level when the R pin is connected with the second pin, and the right detection signal line is pulled down to the low level when the R pin is disconnected with the second pin.

6. The circuit of claim 5, wherein:

the pull-up resistor respectively connected with the L pin and the R pin is larger than 9 to 10 times of an earphone coil resistor.

* * * * *